US008360812B2

(12) United States Patent
Osvatic et al.

(10) Patent No.: US 8,360,812 B2
(45) Date of Patent: Jan. 29, 2013

(54) TAB-FORM TERMINAL WITH REDUCED MATERIAL AND MANUFACTURING COST

(75) Inventors: Michael Osvatic, Glenview, IL (US); Mark Rodaer, Glenview, IL (US)

(73) Assignee: Illinois Tool Works Inc., Glenview, IL (US)

( * ) Notice: Subject to any disclaimer, the term of this patent is extended or adjusted under 35 U.S.C. 154(b) by 187 days.

(21) Appl. No.: 13/055,758

(22) PCT Filed: Jul. 15, 2009

(86) PCT No.: PCT/US2009/050616

§ 371 (c)(1), (2), (4) Date: Jan. 25, 2011

(87) PCT Pub. No.: WO2010/014394

PCT Pub. Date: Feb. 4, 2010

(65) Prior Publication Data

US 2011/0124244 A1 May 26, 2011

Related U.S. Application Data

(60) Provisional application No. 61/083,996, filed on Jul. 28, 2008.

(51) Int. Cl.
*H01R 4/48* (2006.01)

(52) U.S. Cl. ..... 439/819; 439/845

(58) Field of Classification Search ..... 439/819, 439/845, 849, 842, 850, 692
See application file for complete search history.

(56) References Cited

U.S. PATENT DOCUMENTS

| | | | | |
|---|---|---|---|---|
| 2,511,806 | A | 6/1950 | Macy | |
| 2,813,258 | A * | 11/1957 | Klumpp, Jr. | 439/694 |
| 3,134,632 | A * | 5/1964 | Kimball et al. | 439/697 |
| 3,506,950 | A * | 4/1970 | Klumpp, Jr. et al. | 439/869 |
| 3,550,069 | A * | 12/1970 | Teagno et al. | 439/849 |
| 3,742,432 | A * | 6/1973 | Curtis et al. | 439/882 |
| 4,030,804 | A | 6/1977 | Enomoto | |
| 4,691,981 | A | 9/1987 | Coldren | |
| 4,764,133 | A * | 8/1988 | Kaneko | 439/889 |
| 5,591,054 | A | 1/1997 | Okada et al. | |
| 6,238,252 | B1 * | 5/2001 | Flieger | 439/746 |
| 6,293,831 | B1 * | 9/2001 | Yamatani | 439/850 |
| 6,402,575 | B1 | 6/2002 | Suzuki | |

OTHER PUBLICATIONS

ISR for PCT/US2009/050616 mailed Sep. 10, 2009.
Application Specification 114-2036, Manual [on-line.], Typo Electronics, 2005.

* cited by examiner

*Primary Examiner* — Hae Moon Hyeon
(74) *Attorney, Agent, or Firm* — Mark W. Croll; Paul F. Donovan

(57) ABSTRACT

A tab terminal for quick-disconnect type connections is formed by bending a single strip of metal back upon itself. The strip includes inward embossments allowing the desired tab thickness to be obtained with less material while using material suitable for spring contacts or internal device conductors.

19 Claims, 2 Drawing Sheets

TAB-FORM TERMINAL WITH REDUCED MATERIAL AND MANUFACTURING COST

CROSS REFERENCE TO RELATED APPLICATION

This Non-Provisional Application is national phase of International Application Number PCT/US2009/050616 filed Jul. 15, 2009, and claims benefits to U.S. Provisional Application Ser. No. 61/083,996 filed Jul. 28, 2008 and hereby incorporated by reference.

FIELD OF THE INVENTION

The present invention relates to tab-form electrical terminals for use with quick-connect type connectors and the like.

BACKGROUND OF THE INVENTION

Tab-form terminals provide a generally rectangular planar blade that may be received by a variety of different receptacles (connectors) including quick-connect receptacles. The latter quick-connect receptacles provide a channel, for example, with rolled edges capturing the blade between a channel base and the edges. Tab-form terminals may also be used with other receptacle types including "low insertion force" receptacles and connector blocks such as Insulation Displacement Contact Rast-5 connectors having different designs. Such tab-form terminals in the United States normally conform to the requirements of Underwriters Laboratories Inc. (UL) described in Standard for Safety for Electrical Quick-Connect Terminals, UL 310 Seventh Edition, Dated May 27, 2003 adopted as American National Standard (ANSI) ANSI/UL 310 hereby incorporated by reference.

Common receptacles for tab-form terminals compress the blade of the tab-form terminal between resilient elements to provide a contact pressure necessary to reduce the electrical resistance between the receptacle and the blade to prevent overheating of the connection caused by high resistance and to prevent accidental disconnection. These receptacles normally require that the blade of the tab-form terminal have a well-defined thickness (often approximately 0.032 inches) in order to ensure sufficient compressive force between the resilient surfaces while avoiding excess friction.

Different receptacles may contact different portions of a blade of the tab-form terminal with an expectation that the blade will be substantially planar.

SUMMARY OF THE INVENTION

The present invention provides a tab-form terminal using substantially less material than a standard tab-form terminal while working with a variety of different receptacles types. In one embodiment, the tab-form terminal of the present invention eliminates a separate manufacturing step needed to attach the tab-form terminal to a conductor by allowing the reduced thickness material of the tab-form terminal itself to continue as a conductor. Further, this material which may be a spring material (e.g. phosphor bronze) which flexibly supports switch contacts without the need to attach a separate material to the tab-form terminal.

Generally, the tab-form terminal of the present invention employs a single thin strip of metal having a thickness less than half the thickness of the desired terminal blade. The strip is folded lengthwise into two portions forming opposite faces of the terminal blade. The portions are separated by inwardly extending embossments to provide a blade having the desired overall thickness with substantially less material.

Specifically, the present invention provides a tab-form terminal presenting a generally planar blade for receiving along its length a quick-disconnect receptacle of the type comprising generally having opposed surfaces receiving and inwardly compressing outwardly opposed broad faces of the planar blade when received within the channel to provide an electrical connection thereto. The tab-form terminal is constructed of a single strip of metal having a width adapted to be received within a channel section of the receptacle and having an unfolded length longer than the blade and a thickness less than half a thickness of the blade. The length of the strip is divided by a bend extending across the width to fold the single strip of metal back over itself to form the outwardly opposite first and second broad faces of the blade, the strip of metal including inwardly extending spacing elements separating the broad faces by a separation distance greater than twice the thickness of the strip of metal.

It is therefore a feature of a least one embodiment of the invention to decrease the amount of material required to produce a tab-form terminal compatible with standard connectors. It is another feature of at least one embodiment of the invention to permit the fabrication of the tab-form terminal from standard strip stock without the need for wasteful or costly sheet cutting operations.

The bend may divide the single strip into unequal portions so that one opposed side extends beyond the blade as a conductor.

It is therefore a feature of a least one embodiment of the invention to permit a tab-form connector to be formed out of the same material used to provide an attaching electrical conductor without the need for the electrical conductor to be as thick as a standard tab-form terminal.

One opposed side may be attached to an electrical contact and the opposed side may be adapted to flex to make and break an electrical circuit.

It is therefore a feature of a least one embodiment of the invention to permit electrical switch elements to be terminated by tab-form terminals without the need to attach separate terminal materials to the switch components.

The spacing elements may be embossments extending along the width of the single strip of metal.

It is therefore a feature of a least one embodiment of the invention to permit construction of all of the elements of the tab-form terminal from a single metal strip.

The embossments may extend along the width by only a portion of the width.

It is therefore a feature of a least one embodiment of the invention to provide greater stiffness to the blade of the tab-form terminal by preserving unformed portions around the embossments.

At least some of the embossments are centered within the width.

It is therefore a feature of a least one embodiment of the invention to provide a relatively continuous conductive surface on the outer edges of the tab-form terminal such as contact the receptacle.

The bend diameter may be substantially equal to the thickness of the strip.

It is therefore a feature of a least one embodiment of the invention to permit the formation of the tab-form terminal from low ductility materials that will not tolerate zero-radius bends.

The bend may terminate at opposed notches in the strip providing a chamfer at an unsupported end of the blade.

It is therefore a feature of a least one embodiment of the invention to reduce the necessary bending force while providing a guiding chamfer on the tab.

At least one embossment maybe positioned to interact with a detent on the receptacle holding the blade in the receptacle.

It is therefore a feature of a least one embodiment of the invention to permit the same embossments used for spacing to provide a detent against disengagement of the tab-form terminal and the receptacle.

Other features and advantages of the invention will become apparent to those skilled in the art upon review of the following detailed description, claims and drawings in which like numerals are used to designate like features.

Figure 1:
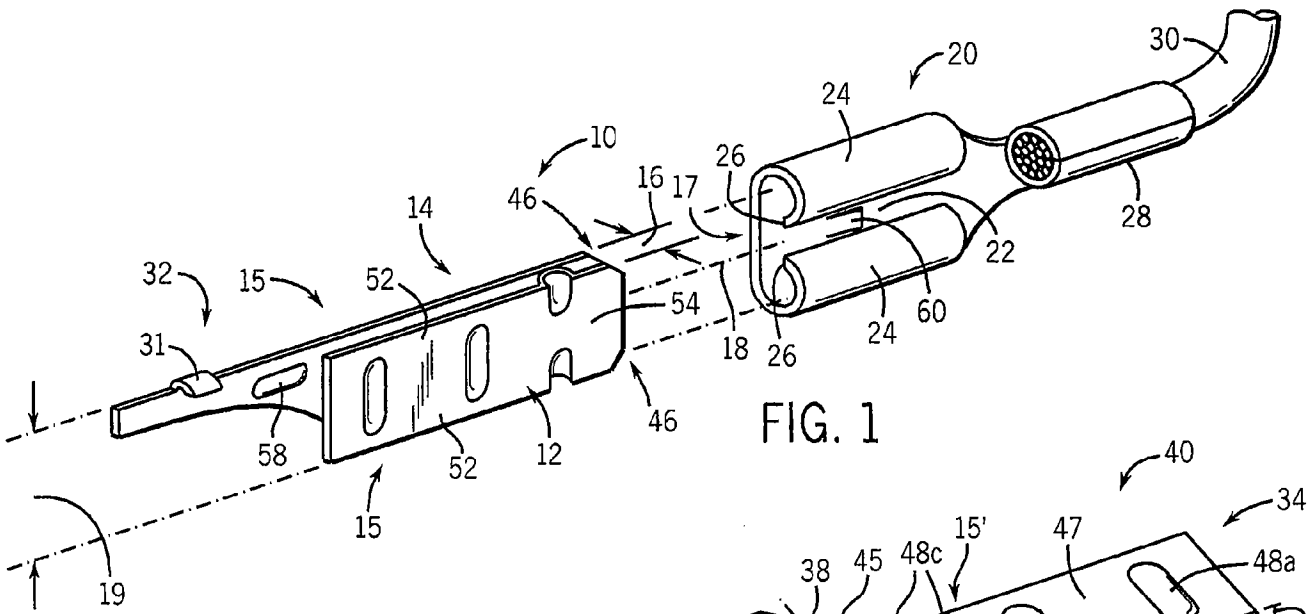
FIG. 1 is an exploded perspective view of the terminal blade of the present invention aligned for receipt by a standard quick connect receptacle.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE PREFERRED EMBODIMENTS

Referring now to FIG. 1, a terminal blade 10 of the present invention provides a generally planar tab having a front face 12 and opposite rear face 14 defining therebetween a tab thickness 16, in one embodiment being approximately 0.032 inches to conform to that of a standard tab-form terminal and may have, for example, a width of 0.110, 0.125, 0.187, 0.205, or 0.250 inches. The front face 12 and rear face 14 extend along an insertion axis 18 to define a tab length and extend perpendicular to the axis 18 to define a tab width 19 between an upper and lower edge 15 of the blade 10.

The blade 10 may be received by a standard quick-connect receptacle 20, one example of which has a base 22 whose front surface slidingly receives the rear face 14 there against. An upper and lower edge 24 of the base 22 are rolled to terminate at inwardly oriented rails 26 parallel to a plane of the base 22 and separated from the base 22 by an amount approximately equal to but slightly less than the thickness of the blade 10 forming a channel 17. Accordingly, when the blade 10 is inserted into the receptacle 20 the upper and lower edges 15 of the blade 10 are guided by the rolled edges 24 and the rails 26 press against the front face 12 to press the rear face 14 of the blade 10 against base 22. The receptacle 20 may have a crimp tube 28 permitting it to be electrically joined to a multi-strand wire conductor 30 of a type known in the art.

The rear face 14 of the blade 10 may have an extension portion 32 extending along the axis 18 away from the direction in which it is received by receptacle 20 to provide a means for electrical connection between the blade 10 to an associated electrical device or circuit. A wire (not shown) may be spot welded to the extension portion 32 or crimped to the extension portion 32 by tab 31.

Figure 2:
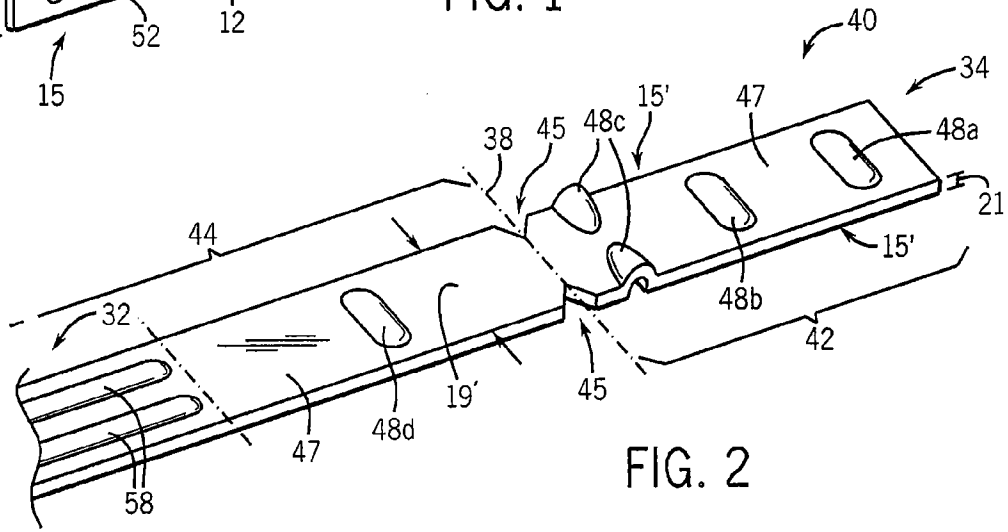
FIG. 2 is a perspective view of a metal strip as prepared before bending into the terminal blade of FIG. 1.

Referring now also to FIG. 2, the blade 10 may be constructed from a single metal strip 34 of an electrically conductive material such as a phosphor bronze, brass or beryllium copper, and may have a width 19' substantially equal to the width 19 of the finished blade 10 and extending between edges 15' of the strip 34. Generally a length of the strip 34 will be no less than twice the length of the blade 10 and the strip 34 may have a thickness 21, for example, of 0.008-0.012 inches in thickness. The thickness 21 of the strip 34 will be less than half the thickness 16 of the blade 10 and preferably approximately one third of that thickness of the blade 10.

In forming the blade 10, the strip 34 will be folded back along itself along a bend line 38 crossing the width 19' and dividing a first end 40 of the strip 34 into a first portion 42 as will form the front face 12 of the blade 10, and a second portion 44 as will form the rear face 14 of the blade 10 and extension portion 32. V-shaped notches 45 may be cut in the edges 15' of the strip 34, their vertices providing endpoints of the bend line 38 to facilitate the bend and provide a corresponding chamfer 46 (shown in FIG. 1) on the leading edge of the blade 10 assisting in the guidance of the blade 10 into the receptacle 20 by providing a slightly sharpened leading edge of the blade 10. This chamfer 46 is augmented by a chamfer-like edge provided by the outer bend radius of the strip 34 at the bend line 38.

Figure 3:
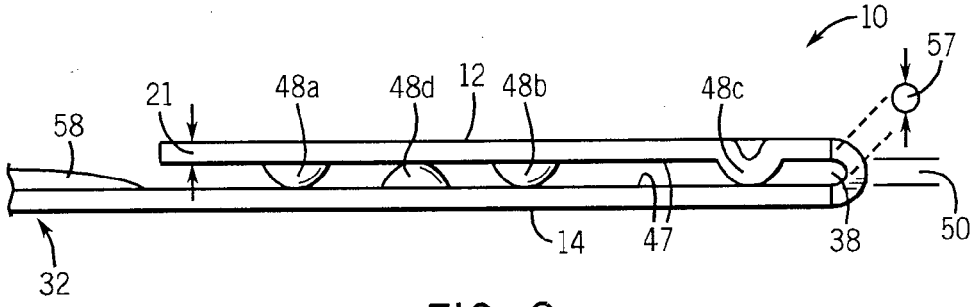
FIG. 3 is a side elevational view of the metal strip of FIG. 1 after folding into the terminal blade.

Referring now to FIGS. 2 and 3, inner faces 47 of the portions 42 and 44 (as will be opposed when the strip 34 is folded into the blade 10) may include embossments 48*a-d* extending outward (upward as depicted) from the inner faces 47. In this embodiment, the portion 42 has two embossments 48*a* and 48*b* extending a portion of the width 19 of the strip 34 and having a raised height 50 defining the separation of the inner faces 47 of the portions 42 and 44 when they are folded together to form the blade 10 as depicted in FIG. 3. The embossments 48*a* and 48*b* are centered between the edges 15' of the strip 34 so as to provide a substantially planar margin 52 to the front face 12 (shown in FIG. 1) such as will receive pressure from the rails 26. In contrast, embossments 48*c* may extend inward from edges 15' to provide a planar gap 54 (shown in FIG. 1) between them. The use of both types of embossments represented by embossments 48*a* and 48*c* provide improved separation stabilization of the portions 42 and 44 against torsion about the axis 18. Generally, the embossments 48*a-d* support the portions 42 and 44 presenting front face 12 and rear face 14 to remain parallel under compression.

An additional embossment 48*d* may be formed in the inner face 47 of the portion 44 that will become the rear face 14 positions to lie between embossments 48*a* and 48*b* when the strip is folded to the form of the blade 10 as shown in FIG. 3. The embossments 48*a-d* may have a rounded form to prevent tearing of the metal of the strip 34 and yet in combination provide stable support.

Referring momentarily to FIGS. 1, 2 and 3, embossment 48*d* may be positioned so as to interact with a detent portion 60 formed in the base 22 of the receptacle 20 to prevent disengagement of the receptacle 20 and blade 10.

Additional longitudinal embossments 58 may be placed in the portion 44 of the strip 34 that forms the extension portion 32 to provide for stiffening of a conductor portion of the strip 34 attached to the blade 10 which comprises only a single thickness of material. The longitudinal embossments 58 may, for example, be in a length of the extension portion 32 anchoring the blade 10 to a housing or the like. These longitudinal embossments 58 extend generally along the length of the strip 34 and may be inward or outwardly facing.

The embossments 48*a-d* may be formed by a stamping operation performed on the blank of the strip 34 and the notches 45 cut by a punching operation. Generally these operations may be conducted in tandem and produce very little waste. It will be understood that the embossments may be given different orientations and positions from those shown to comport with different receptacles and the contact areas associated with those receptacles or for reasons of manufacturing convenience.

Figure 4:
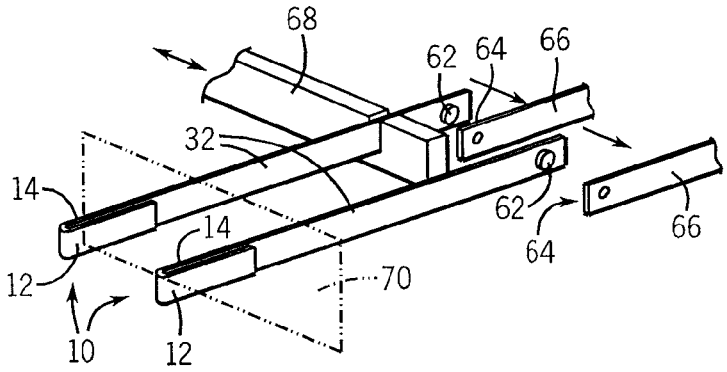
FIG. 4 is a simplified perspective view in phantom of a switch having flexible contact carriers terminating in terminal blades per the present invention.

Referring now to FIG. 4, the extension portions 32 may provide not only for electrical conductors (being practical because of the reduced material thickness) but may also provide flexible carrier strips for electrical contacts 62 in an electrical switch. In this case, the electrical contacts 62 may be supported at cantilevered ends of the extension portions 32 to switchably engage opposing contacts 64 mounted on stationary elements 66 when the extension portions 32 are flexed by an operator 68. In this application, a portion of the extension portion 32 (for example that containing longitudinal embossments 58 shown in FIGS. 2 and 3) may be embedded in a housing wall 70

Referring to FIG. 3, it will be understood that the present invention permits the formation of the blade 10 from a spring-like material suitable for holding electrical switch contacts, in part, because of the large bending diameter 57 enabled by the embossments 48*a-d*. The embossments 48*a-d* together define the separation of the inner faces 47 which substantially equals the bending diameter 57 which, in a preferred embodiment, will be approximately one-third of the thickness 16 of the blade 10. By increasing the bending diameter 57 to above the "zero radius" (i.e., zero diameter) bend often used in the industry, a stiffer and less ductile material may be used for the strip 34 eliminating the need to mechanically attach a separate material to the blade 10 for contact supports.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

We claim:

1. A tab-form electrical terminal presenting a generally planar blade for receiving along its length a quick-disconnect receptacle having generally a channel having opposed surfaces receiving and inwardly compressing outwardly opposed broad faces of the planar blade when received within the channel to provide an electrical connection thereto, the tab-form terminal comprising:

a single strip of metal having a width adapted to be received within the channel of the receptacle and having an unfolded length longer than the planar blade and a thickness less than half a thickness of the planar blade, the length divided by a bend extending across the width to fold the single strip of metal back over itself to form the outwardly opposed broad faces of the planar blade, the single strip of metal including inwardly extending spacing elements separating the broad faces by a separation distance greater than twice the thickness of the single strip of metal;

wherein the inwardly extending spacing elements are positioned to separate edges of the single strip of metal opposed across its width, when the single strip of metal is folded back over itself.

2. The tab-form terminal of claim 1 wherein the bend divides the single strip of metal into unequal portions so that one opposed side extends beyond the planar blade as a conductor.

3. The tab-form terminal of claim 1 wherein spacing elements are embossments of the single strip of metal.

4. The tab-form terminal of claim 3 wherein the embossments extend along the width.

5. The tab-form terminal of claim 4 wherein at least some of the embossments are centered within the width.

6. The tab-form terminal of claim 4 wherein at least one pair of embossments extend inward from edges of the single strip of metal.

7. The tab-form terminal of claim 3 wherein a least one embossment is positioned to interact with a detent on the receptacle holding the planar blade in the receptacle.

8. The tab-form terminal of claim 1 wherein the single strip of metal is formed of a material selected from the group consisting of phosphor bronze, brass and beryllium copper.

9. The tab-form terminal of claim 1 wherein the single strip of metal has a thickness of less than 0.015 inches.

10. The tab-form terminal of claim 1 wherein the single strip of metal has a thickness of less than 0.012 inches.

11. The tab-form terminal of claim 1 wherein the bend diameter is substantially equal to thickness of the single strip of metal.

12. The tab-form terminal of claim 1 wherein the bend terminates at opposed notches in the single strip of metal providing a chamfer at an unsupported end of the planar blade.

13. A tab-form electrical terminal presenting a generally planar blade for receiving along its length a quick-disconnect receptacle having generally a channel having opposed surfaces receiving and inwardly compressing outwardly opposed broad faces of the planar blade when received within the channel to provide an electrical connection thereto, the tab-form terminal comprising:

a single strip of metal having a width adapted to be received within the channel of the receptacle and having an unfolded length longer than the planar blade and a thickness less than half a thickness of the planar blade, the length divided by a bend extending across the width to fold the single strip of metal back over itself to form the outwardly opposed broad faces of the planar blade, the single strip of metal including inwardly extending spacing elements separating the broad faces by a separation distance greater than twice the thickness of the single strip of metal wherein the bend divides the single strip of metal into unequal portions so that one opposed side extends beyond the planar blade as a conductor wherein the one opposed side holds an electrical contact.

14. The tab-form terminal of claim 13 wherein the one opposed side is adapted to flex to make and break an electrical circuit.

15. A method of forming a tab-form electrical terminal presenting a generally planar blade extending along an axis for being received along the axis of a quick-disconnect receptacle having generally a channel having opposed surfaces receiving and inwardly compressing outwardly opposed broad faces of the planar blade when received within the channel to provide an electrical connection thereto, the method comprising:

(a) cutting a single strip of sheet metal stock having a width adapted to be received within a channel section of the receptacle and having an unfolded length longer than the planar blade and a thickness less than half a thickness of the planar blade;

(b) forming embossments in at least a portion of the single strip of sheet metal stock;

(c) bending the single strip of sheet metal stock along a bend line dividing the single strip of sheet metal stock into two sides so that the two sides form substantially parallel sides of the planar blade, the bend having a bend radius separating the opposed sides from each other by a separation distance when the single strip of sheet metal stock is folded back over itself;

wherein the embossments are positioned to extend inwardly from at least one side holding the sides in separation against inward compression forces on the planar blade; and wherein the inwardly extending embossments are positioned to separate edges of the single strip of sheet metal stock opposed across its width, when the single strip of sheet metal stock is folded back over itself.

16. The method of claim 15, before step (c), further including the step of cutting notches in the single strip of sheet metal stock at edges of the bend line providing a chamfer at an unsupported end of the planar blade.

17. The method of claim 15 wherein the single strip of sheet metal stock is a metal strip having a thickness of less than 0.015 inches.

18. The method of claim 15 wherein a least one embossment interacts with a detent on the receptacle holding the planar blade in the receptacle.

19. The method of claim 15 wherein the single strip of sheet metal stock has a width selected from the group consisting of 0.110, 0.125, 0.187, 0.205, or 0.250 inches.

* * * * *